US006279899B1

(12) United States Patent
Coffey et al.

(10) Patent No.: US 6,279,899 B1
(45) **Date of Patent: *Aug. 28, 2001**

(54) SUBSTRATE SENSING MECHANISM FOR USE IN A PRINTER OUTPUT BIN

(75) Inventors: Johnnie A. Coffey, Winchester; David Erwin Rennick, Georgetown; Kevin Dean Schoedinger, Nicholasville; William Joseph Thornhill, Lexington, all of KY (US)

(73) Assignee: Lexmark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/390,504

(22) Filed: Sep. 3, 1999

(51) Int. Cl.[7] ..... B65H 31/26
(52) U.S. Cl. ..... 271/220; 271/258.02; 270/58.02
(58) Field of Search ..... 271/220, 3.04, 271/176, 288, 298, 258.01, 258.02, 256; 221/6, 17; 414/790.9; 270/58.18, 58.02

(56) References Cited

U.S. PATENT DOCUMENTS

| | | | | |
|---|---|---|---|---|
| 2,257,469 | | 9/1941 | Keil . | |
| 2,556,240 | | 8/1951 | Mursch . | |
| 2,566,240 | | 8/1951 | Mursch . | |
| 3,722,879 | | 3/1973 | Johnston et al. . | |
| 4,068,839 | | 1/1978 | Bullock et al. . | |
| 4,273,325 | * | 6/1981 | Rodewald | 271/220 |
| 4,296,684 | | 10/1981 | Wangermann . | |
| 4,345,754 | * | 8/1982 | Willenbring | 271/209 |
| 4,469,320 | | 9/1984 | Wenthe, Jr. . | |
| 4,571,055 | | 2/1986 | Nishiyama . | |
| 4,589,645 | | 5/1986 | Tracy . | |
| 4,776,578 | | 10/1988 | Hirakawa et al. . | |
| 5,033,731 | | 7/1991 | Looney . | |
| 5,197,728 | * | 3/1993 | Radtke | 271/220 |
| 5,215,301 | | 6/1993 | Oshino et al. . | |
| 5,260,759 | | 11/1993 | Kobayashi . | |
| 5,284,337 | | 2/1994 | Ettischer et al. . | |
| 5,294,107 | | 3/1994 | Allmendinger et al. . | |
| 5,470,050 | | 11/1995 | Anma . | |
| 5,478,062 | | 12/1995 | Horiuchi et al. . | |
| 5,518,230 | | 5/1996 | Scarlata et al. . | |
| 5,524,877 | | 6/1996 | Weber et al. . | |
| 5,551,686 | | 9/1996 | Sanchez et al. . | |
| 5,678,818 | | 10/1997 | Hayashi et al. . | |
| 5,758,249 | | 5/1998 | Dutton et al. . | |
| 5,810,348 | | 9/1998 | Scheufler . | |
| 5,810,353 | | 9/1998 | Baskette et al. . | |
| 5,963,754 | * | 10/1999 | Itoh et al. | 271/258.01 |
| 6,170,821 | * | 1/2001 | Kubota | 271/58.01 |

FOREIGN PATENT DOCUMENTS

| | | | | |
|---|---|---|---|---|
| 63-101266A | * | 5/1988 | (JP) | 271/220 |

* cited by examiner

*Primary Examiner*—H. Grant Skaggs
(74) *Attorney, Agent, or Firm*—John A. Brady

(57) ABSTRACT

A substrate sensing mechanism is provided for use in a printer output bin. The sensing mechanism includes a flag having a shape such that when one or more substrates, which have been removed from the bin, are manually reinserted into the bin, the one or more substrates are directed beneath the flag without causing a substrate feed failure. The flag is also positioned and shaped so as to move to a full bin position when a portion of one or more curled substrates extends to or above a level of the substrate output path immediately adjacent the bin entrance.

6 Claims, 6 Drawing Sheets

FIG, 2A

SUBSTRATE SENSING MECHANISM FOR USE IN A PRINTER OUTPUT BIN

FIELD OF THE INVENTION

This invention relates to a substrate sensing mechanism for use in a printer output bin wherein the sensing mechanism is capable of detecting when a portion of one or more edge curled or bent sheets extends to or above a level of a substrate output path immediately adjacent an entrance into the bin.

BACKGROUND OF THE INVENTION

U.S. Pat. No. 5,551,686 to Sanchez et al. discloses a mailbox unit comprising a plurality of bins adapted to received printed substrates from a printer. The '686 patent further describes a sensor for detecting an almost-full bin condition and a bin-full condition in a bin. The sensor comprises two integral switches and an actuating arm. The end of the arm opposite the switches is provided with a rotatable ball for engaging substrates. The switch and the arm may be mounted to or under the bottom of an overlying tray. The '686 patent teaches in column 10, lines 40–46, "[t]he switch arm 12*c* end location * * * should preferably not be located near the sheet stack edge, i.e., be more centrally located in the bin, so as to avoid stack height sensing errors from edge curled or bent paper in the bins changing the true stack height * * * ." The apparatus disclosed in the '686 patent further includes an optical bin-empty sensor.

U.S. Pat. No. 5,033,731 to Looney discloses a stack height and sheet delivery detector system for use in a printer output bin. The detector system comprises an elongated actuating arm 22 pivotally connected to a frame about an axis which extends generally transverse to a printed sheet output path. The arm normally rests by gravitational force on the top sheet of a stack of printed sheets in the printer output bin. Printed sheets are sequentially fed into the bin for stacking by exit feed rollers along the printed sheet output path. As each sheet passes through the feed rollers, its leading edge pushes forward and lifts the pivotal arm upward to a sheet delivery detection position. In this position, an extension of the arm functions to actuate an optical sensor providing an output signal indicative of an incoming sheet. The arm then drops down to its normal position where it rests on top of the upper-most sheet. Once the arm "rest" position on the top of the sheet stack rises above a preset level, the same or another sensor is actuated by the extension on the arm indicating that a desired stacking level has been attained.

Another known sensor for detecting at least one printed substrate fill condition in an output bin comprises a main body pivotably mounted under the bottom of an overlying tray about an axis which is generally parallel to a path that printed substrates follow as they move into the bin. The main body is spaced from an edge of its corresponding bin. It is shaped like an isosceles triangle and is mounted such that its two side edges of equal length are positioned toward the entrance into the bin and toward the end of the bin opposite the bin entrance. When in its home position, the main body is positioned at an angle of about 45 degrees to vertical. As substrates are fed into the bin, they engage the first side edge of the main body causing it to pivot upward. It is believed that the main body, when moved a sufficient distance upward, actuates a corresponding sensor such that the sensor indicates a "full bin" condition.

None of the sensors described above are capable of detecting when a portion of an edge curled or bent sheet extends to or above a level of a substrate output path immediately adjacent a bin entrance. If a portion of a curled or bent sheet extends to or above a level of the substrate output path immediately adjacent the bin entrance, it may cause a substrate feed failure, e.g., a paper jam, as an incoming substrate may engage the curled or bent substrate. Accordingly, there is a need for an improved sheet sensing mechanism for use in a printer output bin wherein the sensing mechanism is capable of detecting when a portion of an edge curled or bent sheet extends to or above a level of a substrate output path immediately adjacent a bin entrance.

SUMMARY OF THE INVENTION

This need is met by the present invention wherein an improved substrate sensing mechanism for use in a printer output bin is provided. The sensing mechanism includes a flag having a shape such that when one or more substrates, which have been removed from the bin, are manually reinserted into the bin, the one or more substrates are directed beneath the flag without causing a substrate feed failure. The flag is also positioned and shaped such that it is capable of detecting when a portion of an edge curled or bent substrate extends to or above a level of a substrate output path immediately adjacent a bin entrance. The edge curled substrate may be curled along the length axis of the substrate which axis is parallel to the printed substrate output path. The flag is light weight, comprises only a single element in the preferred embodiment, is mounted in an out-of-the-way location to the side of the bin about an axis generally parallel to the printed substrate output path, and is configured such that it is operable within a small vertical space between two adjacent bins in a multi-bin structure.

In accordance with one aspect of the present invention, a flag is provided which is adapted for use in a substrate sensing mechanism. The sensing mechanism is coupled to a printer output bin having an entrance through which printed substrates pass as they move along a printed substrate output path for stacking within the bin. The flag comprises a main body portion adapted to be movably coupled to the printer output bin and to extend across the printed substrate output path. The main body portion has first and second arcuate side portions. The first arcuate side portion faces the bin entrance and the second arcuate side portion faces an end of the bin opposite the entrance. The first arcuate side portion is shaped such that a substrate entering the bin is directed beneath the main body portion and the second arcuate side portion is shaped such that when one or more substrates are manually inserted through an end of the bin opposite the bin entrance the one or more substrates are directed beneath the main body portion.

The flag preferably further includes an encoded portion coupled to the main body portion. The encoded portion moves with the main body portion so as to activate sensor apparatus to indicate one of a plurality of printed substrate fill conditions in the bin. More specifically, the encoded portion is configured such that it allows a first of two optical sensor beams to activate a sensor when one or more printed substrates are in the bin and the bin is not full or in its near full condition, allows neither of the two optical sensor beams to activate a sensor when a near bin full condition exists, allows a second of the two optical sensor beams to activate a sensor when a bin full condition exists or a portion of a curled substrate extends to or above a level of the bin entrance, and allows both beams to actuate a sensor when no printed substrates are in the bin.

The flag may further include an attachment portion coupled to the main body and encoded portions. The attachment portion is adapted to be pivotally coupled to the bin such that the main body and encoded portions pivot relative to the bin.

Preferably, the main body, encoded and attachment portions are integrally formed as a single element. It is also preferred that they be formed from a polymeric material such as a polycarbonate/acrylonitrile butadiene styrene (ABS) blend. A polycarbonate/ABS blend which may be employed is one which is commercially available from the General Electric Company under the trademark CYCOLOY 6200.

In accordance with a second aspect of the present invention, a substrate sensing mechanism is provided which is adapted to be coupled to a printer output bin having an entrance through which printed substrates pass as they move along a printed substrate output path for stacking within the bin. The sensing mechanism comprises a flag pivotably mounted to a side portion of the bin and sensor apparatus coupled to the bin. The flag extends across the printed substrate output path and is shaped so as to move to a full bin position when a portion of one or more curled substrates extends to or above a level of the substrate output path immediately adjacent the bin entrance. The sensor apparatus is coupled to the bin and responds to movement of the flag so as to generate output signals indicative of one of a plurality of printed substrate fill conditions in the bin.

An object of the present invention is to provide an improved flag for use in a substrate sensing mechanism.

Another object of the present invention is to provide an improved substrate sensing mechanism for use in a printer output bin.

A further object of the present invention is to provide a substrate sensing mechanism which includes a flag having a shape such that when one or more substrates, which have been removed from the bin, are manually reinserted into the bin, the one or more substrates are directed beneath the flag without causing a substrate feed failure.

A still further object of the present invention is to provide a substrate sensing mechanism which includes a flag positioned and shaped such that it is capable of sensing when a portion of one or more curled substrates extends into or above the substrate output path immediately adjacent the bin entrance.

Other objects will be readily perceived from the following description, claims, and drawings.

BRIEF DESCRIPTION OF THE DRAWINGS

FIG. 2A is a perspective view of a flag mounting portion;

DETAILED DESCRIPTION OF PREFERRED EMBODIMENTS

Figure 1:
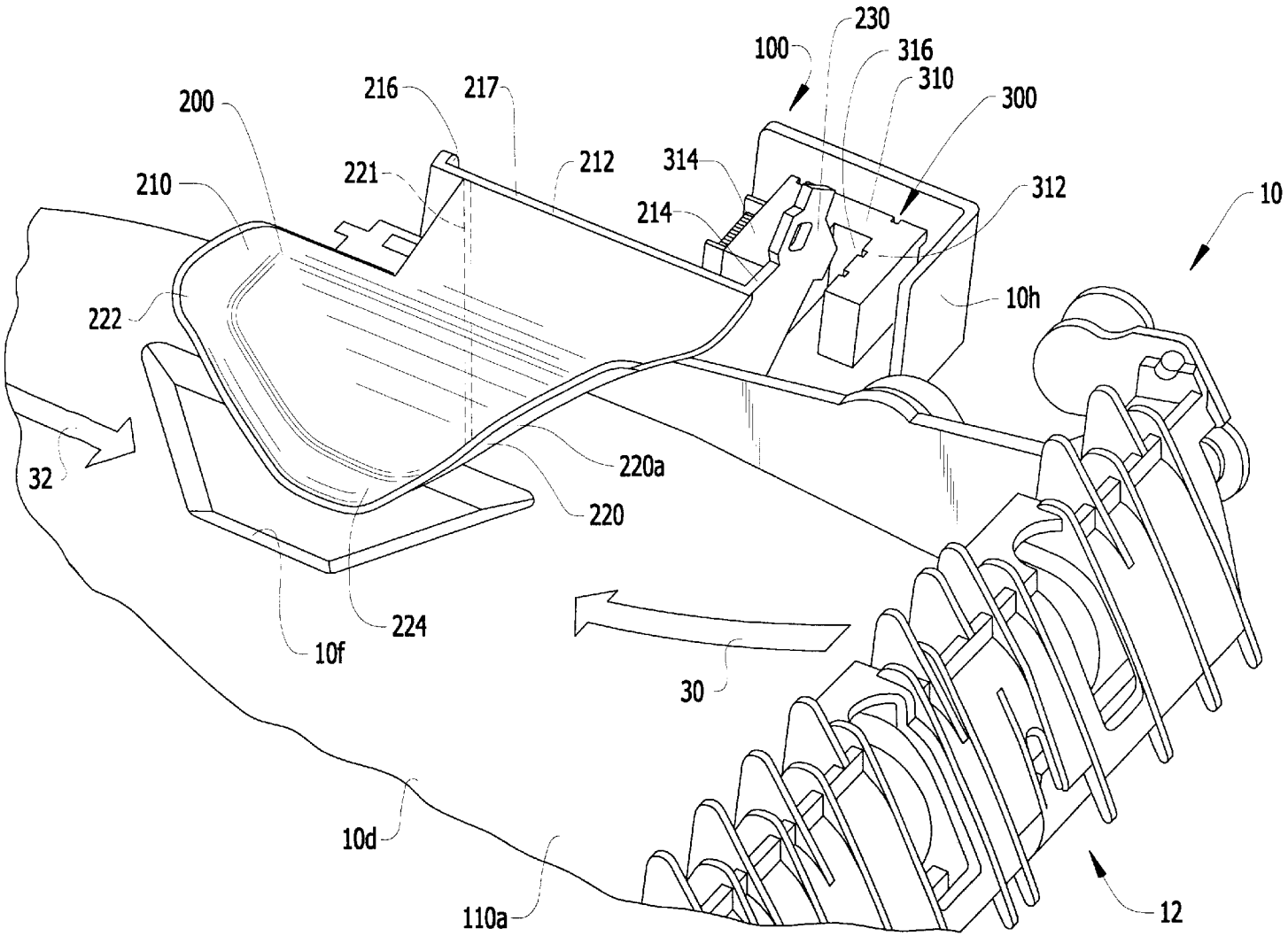
FIG. 1 is a perspective view of a portion of a printer output bin to which a substrate sensing mechanism of the present invention is coupled.

In FIG. 1, a substrate sensing mechanism 100 constructed in accordance with the present invention is shown coupled to a printer output bin 10. The bin 10 has an entrance 12 through which printed substrates (not shown in FIG. 1) pass as they move along a printed substrate output path 30, represented by an arrow in FIG. 1, for stacking within the bin 10. The sensing mechanism 100 comprises a flag 200 and sensor apparatus 300. The flag 200 includes a main body portion 210 extending across the printed substrate output path 30. As will be discussed below, the flag 200 moves in response to substrates being fed into the bin 10. As will also be discussed below, the sensor apparatus 300 is coupled to the bin 10 and responds to movement of the flag 200 so as to generate output signals indicative of one of a plurality of printed substrate fill conditions in the bin 10.

Figure 2:
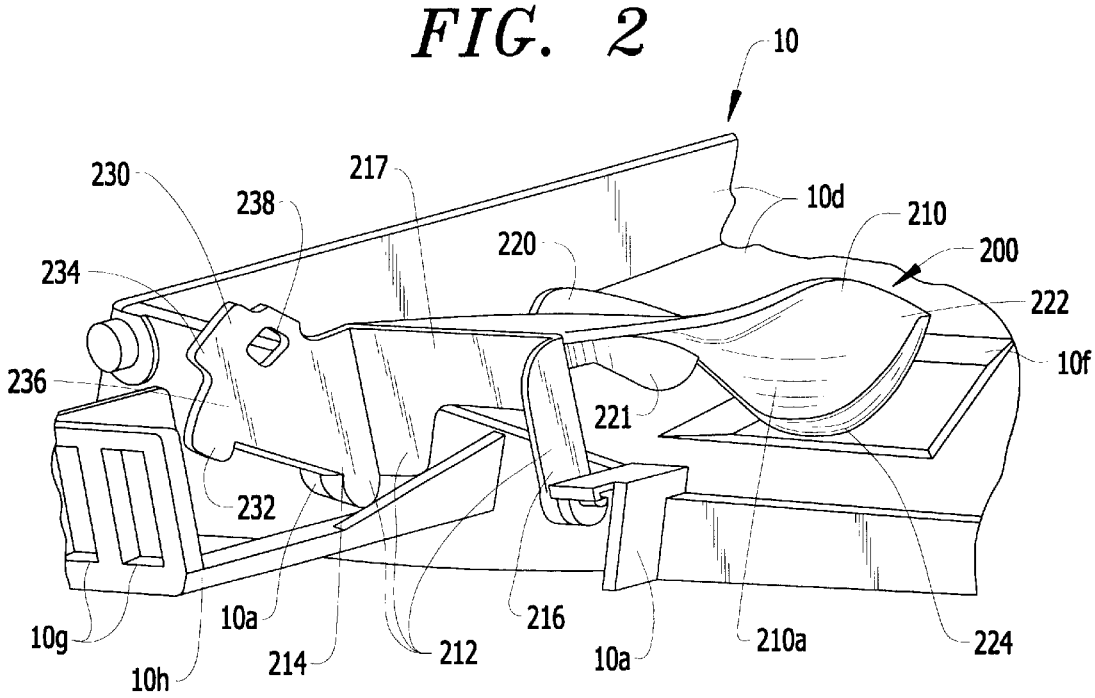
FIG. 2 is perspective view, from a different angle than shown in FIG. 1, of a portion of the printer output bin and the substrate sensing mechanism and with the sensor apparatus removed.
Figure 2:
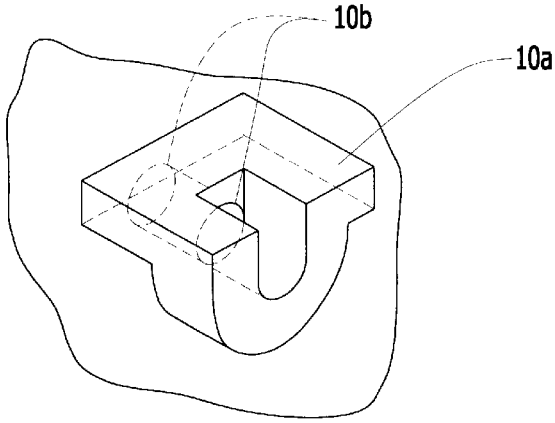

The flag 200 further includes an attachment portion 212 coupled to the main body portion 210, see FIG. 2. It extends generally transversely to the main body portion 210 and includes first and second side sections 214 and 216 and an intermediate section 217 extending between the side sections 214 and 216, see FIG. 2. The first side section 214 is provided with a first outwardly extending pin 214*a*, see FIG. 9. The second side section 216 is provided with a second outwardly extending pin 216*a*, see FIG. 3. The bin 10 includes flag mounting portions 10*a* which, preferably, are integrally formed with a tray 10*d* comprising part of the bin 10, see FIGS. 2 and 2A. A recess 10*b* is provided in each mounting portion 10*a* for receiving one of the first and second pins 214*a* and 216*a*. The flag 200 is pivotally coupled to the bin 10 by inserting the pins 214*a* and 216*a* into the mounting portion recesses. When coupled to the bin 10, the flag 200 is pivotable about an axis $A_1$ which extends generally parallel to the printed substrate path 30, see FIG. 3.

The main body portion 210, in the illustrated embodiment, is formed having first and second arcuate side portions 220 and 222 converging downwardly toward a base portion 224 to form a hollow interior, see FIGS. 1 and 2. It further includes a rib 221 integrally formed on a back side 210*a* of the main body portion 210. The first side portion 220 faces the bin entrance 12 while the second side portion 222 faces an end 10*c* of the bin 10 opposite the bin entrance 12, see FIG. 9. The first side portion 220 has a first length $L_1$ and the second side portion 222 has a second length $L_2$ which is less than the first length $L_1$.

Preferably, the edge 220*a* of the first side portion 220 is spaced from the output bin entrance 12 a distance sufficient to allow printed substrates being fed into the bin 10 to contact the tray 10*d* or other substrates previously stacked in the tray 10*d* prior to contacting any portion of the first side portion 220. It is further preferred that the distance between the bin entrance 12 and the outermost portion of the edge 222*a* of the second side portion 222 be substantially equal to or less than the length of the shortest substrate to be received in the bin 10 so as to minimize interference by the flag 200 with a user's hand when the user removes substrates from the tray 10*d*. For example, in FIG. 9, the outermost portion of the edge 222*a* of the second side portion 222 is shown spaced inwardly from the outermost edge of substrate C, e.g., a 3"×5" card.

After a substrate passes through the bin entrance 12, it continues its movement along the printed substrate output path 30 and eventually contacts the edge 220*a* of the first arcuate side portion 220. The edge 220*a* is rounded, see FIG. 1, and the remaining portion of the main body portion 210 is configured such that a substrate initially makes a substantially single point or limited contact with the edge 220*a* and continues to make a substantially single point or limited contact with the main body portion 210 as it moves into the tray 10*d*, i.e., the limited contact point between the substrate and the main body portion 210 moves along the main body portion 210 as the substrate moves into the tray 10*d*. Single point contact between the main body portion 210 and a substrate is advantageous as it minimizes drag on the substrate, i.e., it minimizes influences on the incoming substrate by the flag 200.

Figure 4:
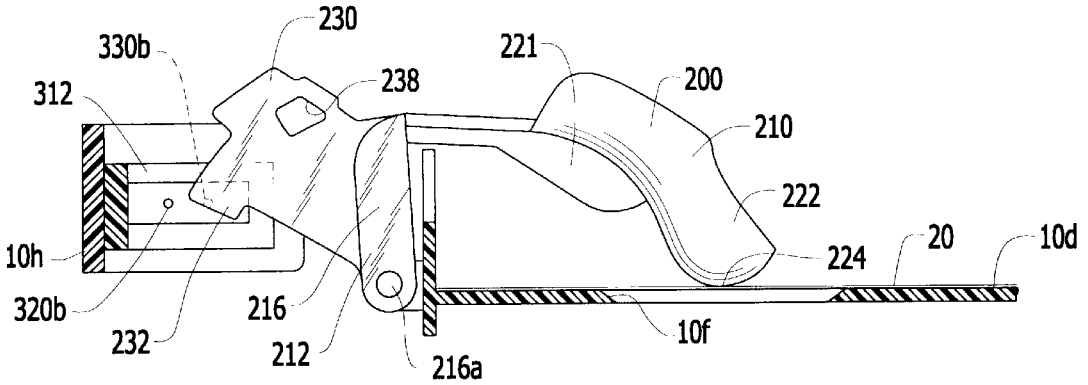
FIG. 4 is a side view, partially in cross section, of the printer output bin and the substrate sensing mechanism and illustrating the second fill condition of the bin.
Figure 5:
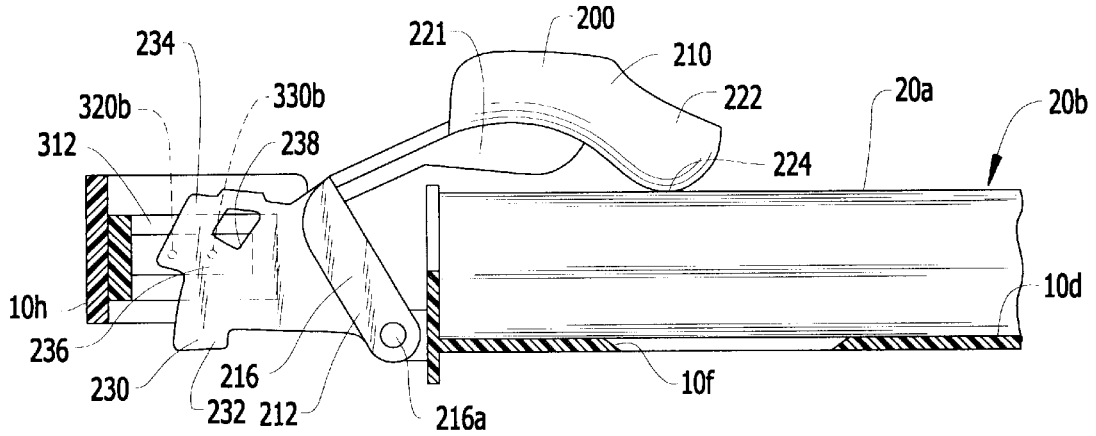
FIG. 5 is a side view, partially in cross section, of the printer output bin and the substrate sensing mechanism and illustrating the third fill condition of the bin.
Figure 6:
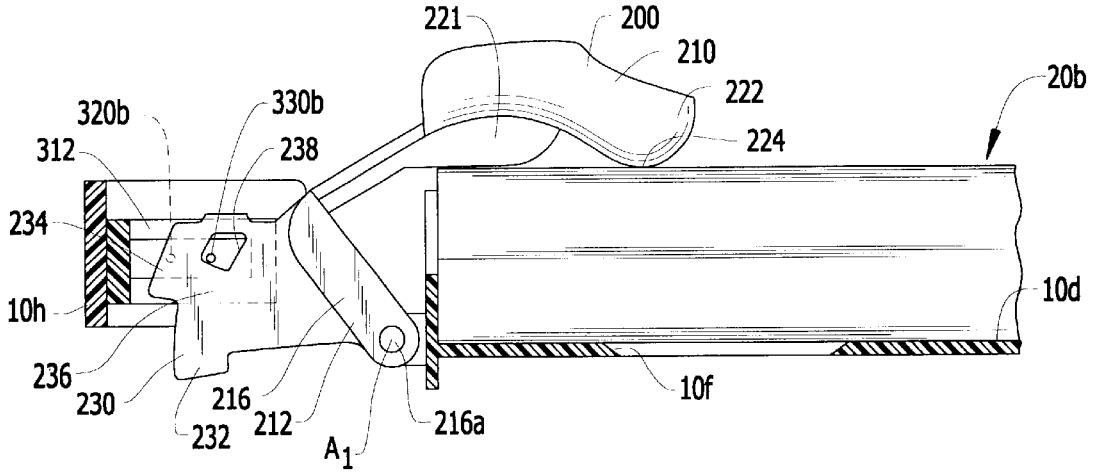
FIG. 6 is a side view, partially in cross section, of the printer output bin and the substrate sensing mechanism and illustrating the fourth fill condition of the bin.

If no substrates are in the tray 10*d* of the bin 10, the substrate moves between the main body portion 210 and the tray 10*d* causing the flag 200 to pivot upwardly about axis $A_1$ against the force of gravity. Hence, the flag 200 is moved from a first fill position, shown in FIG. 3, where its main body portion 210 extends part-way through an opening 10*f* in the tray 10*d*, to a second fill position, shown in FIG. 4. In FIG. 4, a substrate 20 is shown positioned between the tray 10*d* and the main body portion 210. If one or more substrates 20 are located in the tray 10*d* before an incoming substrate moves into the tray 10*d*, the incoming substrate moves between the main body portion 210 and the upper-most substrate 20*a* located in the tray 10*d*. The flag 200 moves upwardly against the force of gravity as substrates are delivered into the tray 10*d*, see FIGS. 5 and 6. In FIG. 5, the flag 200 is shown in a third fill position and in FIG. 6 is shown in a fourth fill or full bin position.

Figure 7:
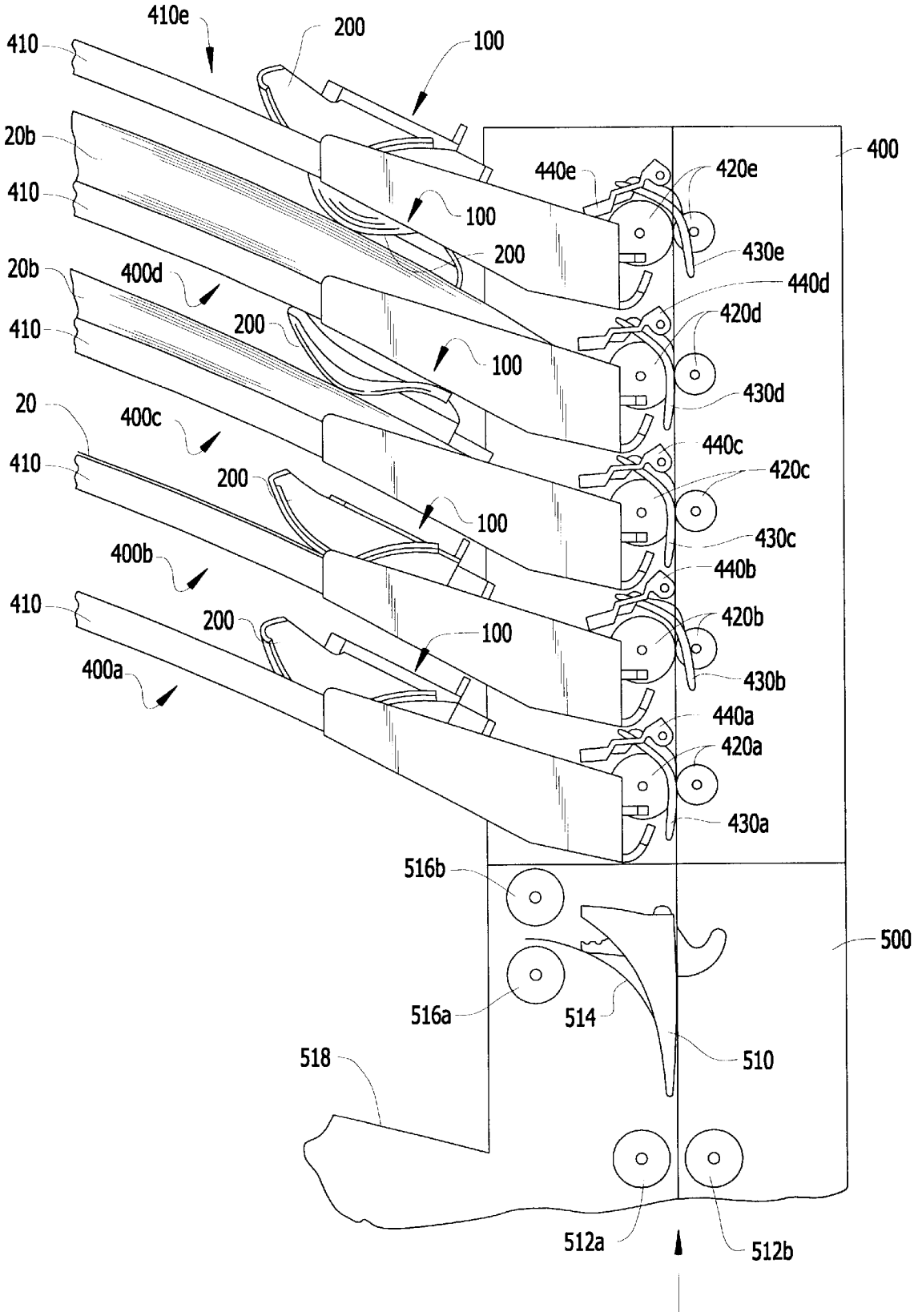
FIG. 7 is a side view of a multi-bin output expander provided on a printer with each bin of the expander provided with a substrate sensing mechanism.
Figure 8:
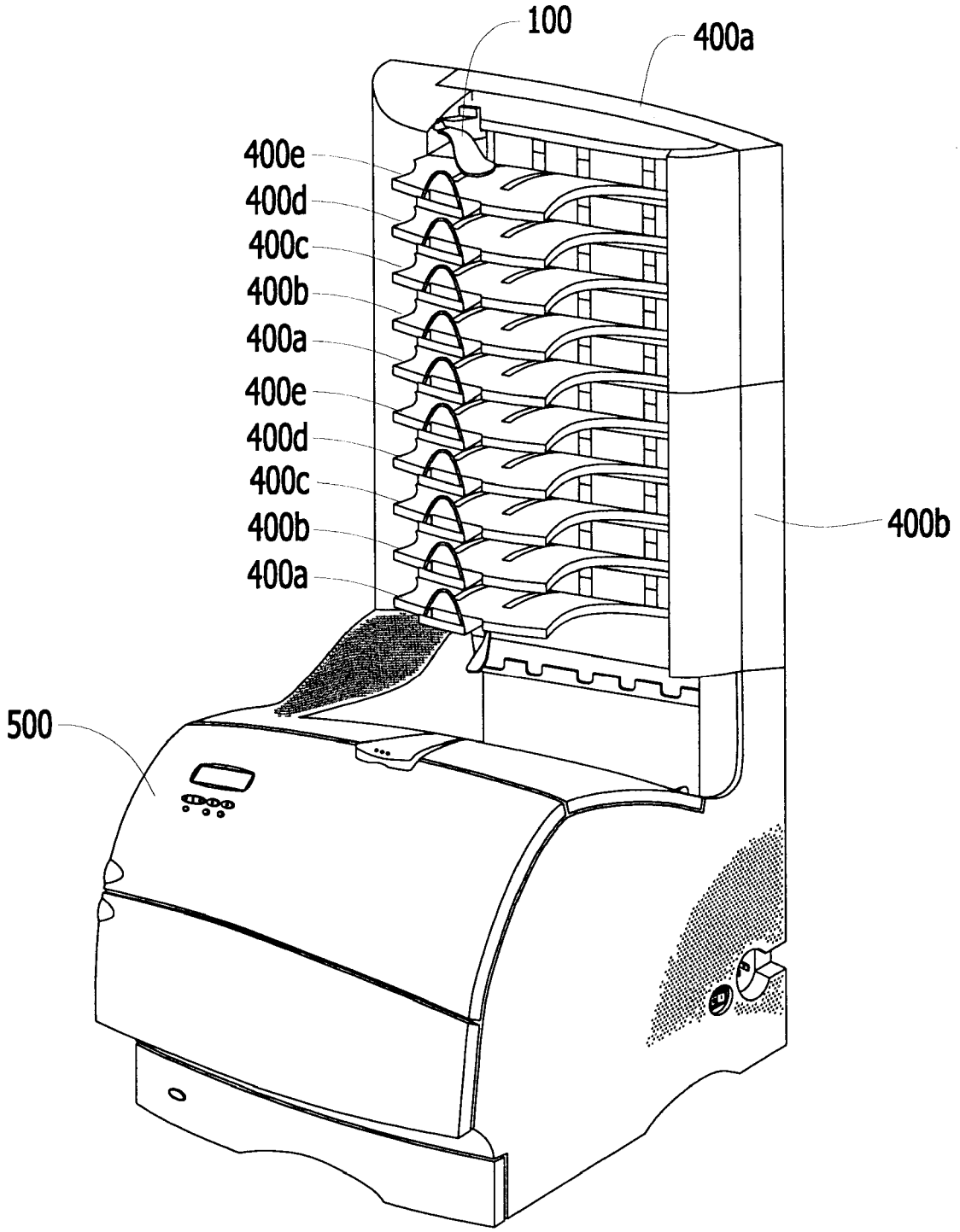
FIG. 8 is a perspective view illustrating a pair of multi-bin output expanders provided on a printer.

Periodically, a user, after removing a stack 20*b* of one or more substrates from a tray 10*d*, may desire to return the removed stack 20*b* to the tray 10*d*. For example, when a multi-bin structure, such as shown in FIGS. 7 and 8, is provided, and each tray is assigned to a different user, a user, after mistakenly pulling substrates from a tray assigned to another user, may attempt to reinsert those documents back into the tray. Due to the contour of the second arcuate side portion 222, when one or more substrates 20 are manually inserted into the tray 10*d* through the end 10*c* of the tray 10*d* opposite the entrance 12, in the direction of arrow 32 illustrated in FIG. 1, the one or more substrates are directed beneath the main body portion 210. If no substrates are in the tray 10*d*, the one or more substrates move between the main body portion 210 and the tray 10*d* causing the flag to pivot upwardly about axis $A_1$ against the force of gravity. If one or more substrates 20 are located in the tray 10*d*, the one or more inserted substrates move between the main body portion 210 and the upper-most substrate 20*a* in the stack 20*b* of substrates 20 located in the tray 10*d*. The insertion of one or more substrates in the direction of arrow 32 will typically not prevent the feeding of a substrate into the tray 10*d* in the direction of arrow 30. This is because the one or more substrates moving in the direction of arrow 32 do not force the flag 200 downwardly toward the substrate stack 20*b* so as to prevent a substrate moving in the direction of arrow 30 from passing beneath the main body portion 210.

The flag 200 further includes an encoded portion 230 coupled to the main body and attachment portions 210 and 212, see FIGS. 1–6. Preferably, the main body, attachment and encoded portions 210, 212 and 230 comprise a single integral element formed from a polymeric material. The encoded portion 230 moves with the main body portion 210 and functions to effect a change in state of the sensor apparatus 300 in response to a substrate fill condition change in the tray 10*d*.

The sensor apparatus 300 comprises a housing 310, see FIG. 1, having four flex arms (not shown) which are adapted to be received in bin recesses 10*g*, see FIG. 2, found in a bin extension 10*h*. The four flex arms releasably couple the housing 310 to the bin 10. The housing 310 further includes first and second legs 312 and 314 which define a slot 316 between them, see FIG. 1. The slot 316 is adapted to receive the encoded portion 230 of the flag 200.

Figure 3:
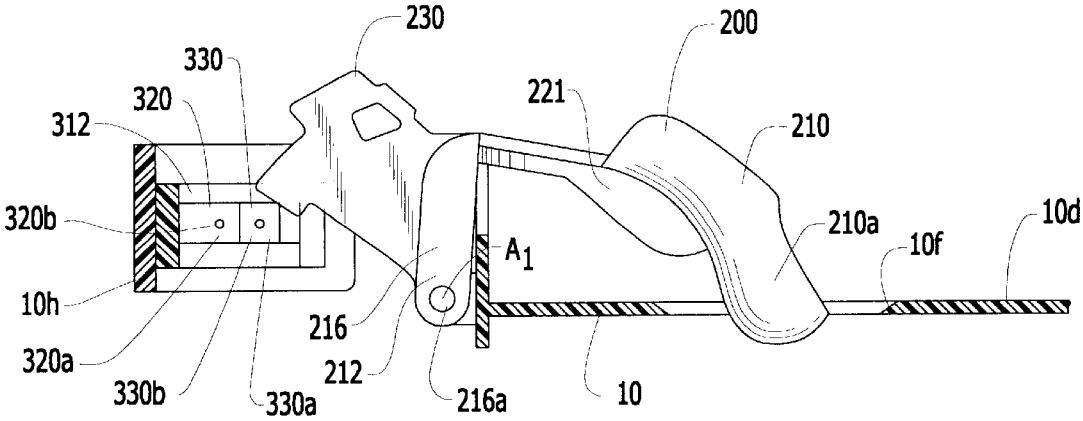
FIG. 3 is a side view, partially in cross section, of the printer output bin and the substrate sensing mechanism and illustrating the first fill condition of the bin.

The sensor apparatus 300 further comprises a first optical sensor 320 having a first beam emitter 320*a*, see FIG. 3, and a first beam detector (not shown) and a second optical sensor 330 having a second beam emitter 330*a* and a second beam detector (not shown). The first and second beam emitters 320*a* and 330*a* are positioned in the housing first leg 312 and generate respectively first and second beams 320*b* and 330*b*, see FIGS. 3–6. The first and second beam detectors are positioned in the second leg 314 of the housing 310. The first and second beams 320*b* and 330*b* extend across the slot 316 and are detected by the first and second detectors unless blocked by the encoded portion 230.

The encoded portion 230 is configured such that it allows the first and second beams 320*b* and 330*b* to pass when the tray 10*d* is completely empty, i.e., when the tray 10*d* is in a first fill condition, see FIG. 3. When one or more substrates are in the tray 10*d* and the tray 10*d* is not full or in its near full condition, i.e., when the tray 10*d* is in a second fill condition, a first extension 232 of the encoded portion 230 blocks the second beam 330*b*, see FIG. 4. However, the first beam 320*b* is allowed to travel across the slot 316 so as to be detected by the first beam detector. When a near bin full condition exists, i.e., when the tray 10*d* is in a third fill condition, see FIG. 5, a second extension 234 and a middle section 236 of the encoded portion 230 block both beams 320*b* and 330*b*. When the tray 10*d* is full with substrates 20, i.e., when the tray 10*d* is in a fourth fill condition, the second extension 234 blocks the passage of the first beam 320*b* while an opening 238 formed in the encoded portion 230 allows the second beam 330*b* to pass through the encoded portion 230 such that it is detected by the second beam detector.

The first and second optical sensors 320 and 330 are coupled to a printer processor (not shown) and provide the processor with signals indicative of the current fill condition of the tray 10. For example, when a first fill condition exists, the first and second detectors sense the two beams 320*b* and 330*b* and generate corresponding signals to the processor indicative of this condition.

As noted above, the main body portion 210 includes a rib 221 integrally formed on a backside 210*a* of the main body portion 210. As is apparent from FIGS. 1 and 9, the rib 221 extends at an angle across the printed substrate output path 30. The rib 221 is shaped such that the main body portion 210 is moved to a full bin position when a portion of one or more curled substrates 20*c* contacts the rib 221 and extends to or above a level $L_e$ of the substrate output path 30 immediately adjacent the bin entrance 12, see FIG. 10. The level $L_e$ or height of the substrate output path 30 immediately adjacent the bin entrance 12 and the level or height of the bin entrance 12 may be slightly different from one another depending upon the angle at which substrates are fed into the bin 10 through the entrance 12. When the flag 200 is moved to its full bin position, the first and second sensors 320 and 330 generate appropriate signals to the processor indicative of a fourth fill or full bin condition. Hence, the processor will respond as if the bin 10 were filled with substrates, i.e., it will prevent further substrates from being fed into the bin 10.

The shape of the rib 221 may be changed from that of the illustrated embodiment so long as the flag 200 is moved to its full bin position when a portion of one or more curled substrates 20*c* extends to or above a level of the substrate output path 30 immediately adjacent the bin entrance 12. It is also contemplated that the flag 200 may be formed without a rib so long as the shape of the flag 200 is such that the flag 200 moves to its fall bin position when a portion of one or more curled substrates 20*c* extends to or above a level of the substrate output path 30 immediately adjacent the bin entrance 12.

The shape of the encoded portion 230 may be changed from that illustrated in FIGS. 3–6 so as to indicate to sensor apparatus one of two, three or more tray fill conditions. The shape may also be changed for other reasons so long as the flag is capable of indicating to sensor apparatus a change in two or more fill conditions.

Other sensor apparatus may be substituted for the illustrated sensor apparatus. For example, the first and second optical sensors may comprise first and second beam emitters and first and second beam detectors, all of which are located in the same leg of the housing 310. In this embodiment, the encoded portion 230 would act to reflect the beams back toward the detectors.

Figure 9:
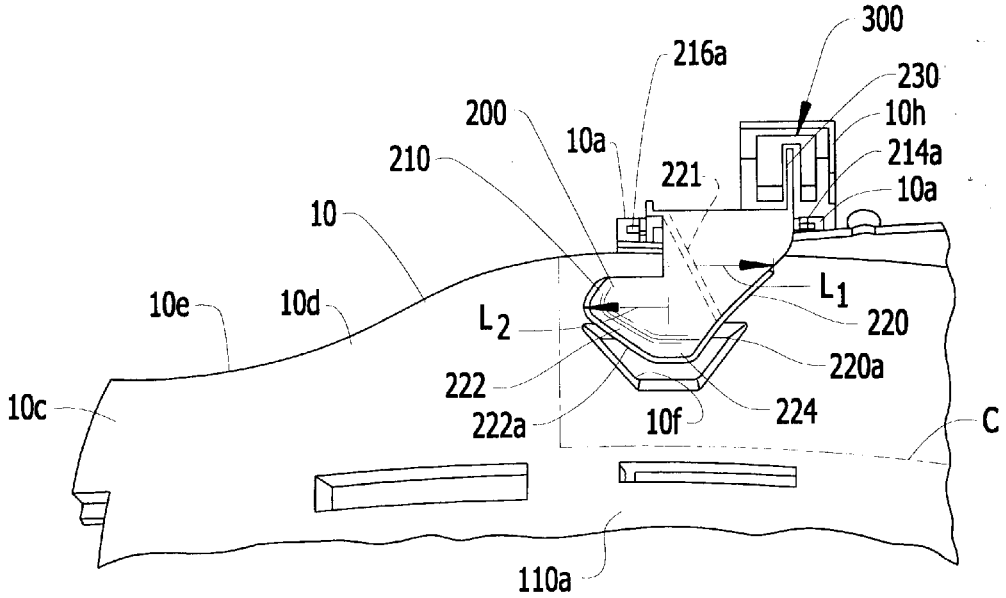
FIG. 9 is a perspective view of a portion of a printer output bin to which a substrate sensing mechanism of the present invention is coupled.
Figure 10:
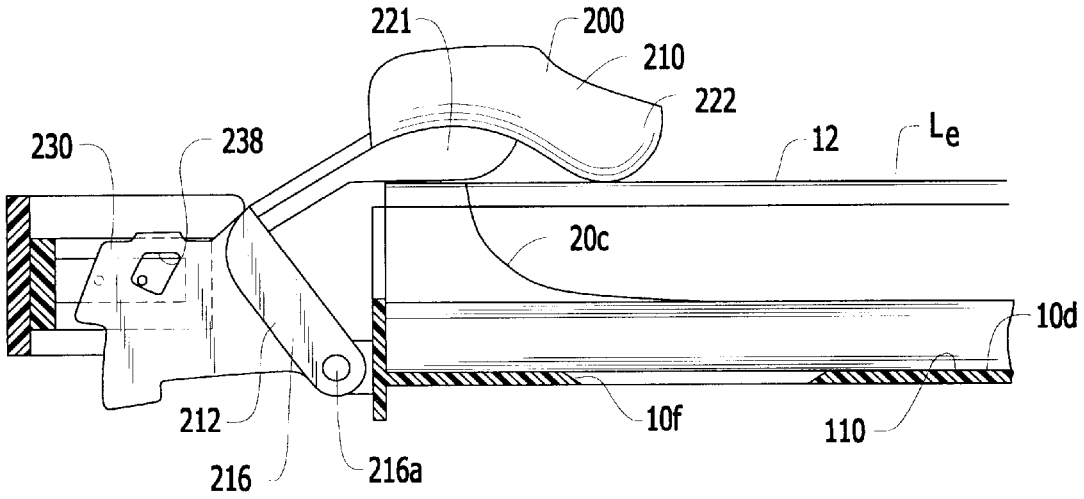
FIG. 10 is a side view showing a curled edge substrate in the bin.

It is also noted that the tray 10*d* has a curved upper surface 110. The tray 10*d* is lowest at the end immediately adjacent the bin entrance 12 and also at the end which defines the bin end 10*c*. The tray's highest point is located between the edge 222*a* of the second side portion 222 and the tray end which defines the bin end 10*c*. The tray 10*d* is also provided with two side recesses 10*e* (only one of which is shown in FIG. 9) to allow for easy access to a stack 20*b* of substrates in the tray 10*d*.

In FIG. 7, a single multi-bin output expander 400 is shown located on a conventional printer 500. The expander 400 comprises five output bins 400*a*–400*e* positioned in a stacked relationship. Each bin includes a substrate-receiving tray 410. A substrate sensing mechanism 100, as described above, is coupled to each tray 410. The expander 400 further includes five sets of cooperating feed rollers 420*a*–420*e*, five substrate diverters 430*a*–430*e*, and five substrate flaps 440*a*–440*e*. The printer 500 includes a pivotally mounted substrate diverter 510 movable between a position shown in FIG. 7 in which it allows a substrate to be fed by a pair of cooperating feed rollers 512*a* and 512*b* into the expander 400 and a position (not shown) in which it diverts a substrate along a path 514 between two cooperating feed rollers 516*a* and 516*b* which, in turn, feed the substrate into a printer bin 518. Conventional drive means (not shown) are provided to effect rotation of the feed rollers 420*a*–420*e* and conventional displacement mechanisms (not shown) are provided to effect movement of the five substrate diverters 430*a*–430*e* and the five substrate flaps 440*a*–440*e*. In FIG. 7, the diverter 430*b* and the substrate flap 440*b* are shown positioned to divert a substrate into the bin 400*b*. The diverter 430*a* is positioned so as to allow a substrate to bypass the bin 400*a*. As is apparent from FIG. 7, the flags 200 are configured so that they are operable within a vertical space between any two adjacent bins 400*a*–400*e* in the expander 400.

In FIG. 8, two expanders 400*a* and 400*b* are shown located on a printer 500. Each bin 400*a*–400*e* in the two expanders 400*a* and 400*b* is provided with a substrate sensing mechanism 100.

It is further contemplated that the shape of the main body portion 210 may be varied. For example, the first and second side portions may be substantially planar and converge downwardly toward a base portion. Other configurations not explicitly set out herein may also be used so long as the main body portion is capable of allowing the reinsertion of one or more removed substrates into the tray 10*d*.

It is also contemplated that an element comprising at least a main body portion and an attachment portion coupled to the main body portion may be pivotably coupled to a side or edge portion of a printer output bin and function as a hold-down weight, i.e., apply a downward force onto one or more substrates located in the bin 10 so as to maintain those substrates in the bin 10 until removed by a user. The main body and attachment portions preferably are shaped in substantially the same manner as the main body and attachment portions 210 and 212 illustrated in FIGS. 1–3. The element may further include a counterweight portion positioned and coupled to the attachment portion in the same manner as the encoder portion 230. It could also be shaped in substantially the same manner as the encoder portion 230. Substrates passing into the bin 10 pass under the main body portion 210 of the element, which rests on the upper-most substrate in the bin 10 and functions as a hold-down weight.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A media contact member coupled to a printer output bin having an entrance through which printed substrates pass as they move along a printed substrate output path for stacking within the bin, said media contact member comprising a main body portion adapted to be movably coupled to the printer output bin and to extend to the printed substrate output path, said main body portion having first and second side portions, said first side portion facing the bin entrance and said second side portion facing an end of the bin opposite the entrance, said first side portion being shaped such that a substrate entering the bin is directed beneath said main body portion and said second side portion being shaped such that when one or more substrates are manually inserted through an end of the bin opposite the bin entrance, the one or more substrates are directed beneath said main body portion, said first side portion extending to a first level above media contacted by said main body portion and said second side portion extending to a second level above media contacted by said main body portion, said second level being less than said first level, wherein said first side portion and said second side portion converge downwardly to form a hollow interior and wherein said main body portion further includes a section extending across said output path shaped such that a portion of one or more curled substrates moves said main body portion to a full bin position when said portion of one or more curled substrates extends to or above a level of the substrate output path immediately adjacent the bin entrance.

2. A media contact as set forth in claim 1, wherein said section comprises a rib.

3. A flag coupled to a printer output bin having an entrance through which printed substrates pass as they move along a printed substrate output path for stacking within the bin, said flag comprising a main body portion adapted to be movably coupled to the printer output bin and to extend to the printed substrate output path, said main body portion having first and second side portions, said first side portion facing the bin entrance and said second side portion facing an end of the bin opposite the entrance, said first side portion being shaped such that a substrate entering the bin is directed beneath said main body portion and said second side portion being shaped such that when one or more substrates are manually inserted through an end of the bin opposite the bin entrance the one or more substrates are directed beneath said main body portion, said main body portion further including a section extending across said output path shaped such that a portion of one or more curled substrates moves said main body portion to a full bin position when said portion of one or more curled substrates extends to or above a level of the substrate output path immediately adjacent the bin entrance.

4. A flag as set forth in claim 3, further comprising an attachment portion coupled to the main body portion and adapted to be pivotably coupled to the bin such that said main body portion pivots relative to the bin.

5. A flag as set forth in claim 4, wherein said section comprises a rib.

6. A flag as set forth in claim 3, wherein said section comprises a rib.

* * * * *